United States Patent [19]

Dibley

[11] Patent Number: 4,781,646

[45] Date of Patent: Nov. 1, 1988

[54] TOY TOASTER OVEN

[75] Inventor: Joseph L. Dibley, New York, N.Y.

[73] Assignee: The Quaker Oats Company, Chicago, Ill.

[21] Appl. No.: 70,947

[22] Filed: Jul. 8, 1987

[51] Int. Cl.[4] ..... A63H 3/52; A63H 33/22

[52] U.S. Cl. ..... 446/219; 446/418; 446/481

[58] Field of Search ..... 446/481, 479, 219, 408, 446/418, 482, 480, 82; 272/1 R; 126/451

[56] References Cited

U.S. PATENT DOCUMENTS 3,765,120 10/1973 Waak ..... 446/481
3,938,497 2/1976 Andrassy ..... 126/451

FOREIGN PATENT DOCUMENTS 338749 7/1959 Switzerland ..... 446/481

*Primary Examiner*—Mickey Yu
*Attorney, Agent, or Firm*—Cumpston & Shaw

[57] ABSTRACT

This invention is directed to a toy toaster oven that simulates real toaster ovens used by adults. The toy toaster oven has a turn-on knob which uncovers a skylight for illuminating light-reflecting material in the oven with ambient light to simulate a glowing electrical heating element for initiation of a heating cycle. To turn off the toy toaster oven, a drive motor latch on-off button is depressed to its "off" position, causing the drive motor to close the skylight, the simulated glowing heating element to cease glowing and a bell to ring indicating that the simulated food item placed in the oven has been fully toasted or baked.

19 Claims, 2 Drawing Sheets

TOY TOASTER OVEN

FIELD OF THE INVENTION

The present invention relates generally to toys, and more specifically to a toy toaster oven that simulates a real toaster oven used by adults.

BACKGROUND OF THE INVENTION

Children love to mimic adults and love to engage in house play in which they cook meals and entertain guests in the same way that adults do. In such house play, it is desirable to provide the children with toy products, such as stoves, tea kettles and the like, that more realistically simulate kitchen products owned and used by adults. To fulfill this need for providing more realistic toys for house playing, an object of the present invention is to provide a toy toaster oven that more realistically simulates toaster ovens used by adults.

SUMMARY OF THE INVENTION

An object of this invention is achieved by providing a toy toaster oven comprising:

an oven compartment at least partially covered by a light-reflecting material;

a sky-light for the oven compartment;

a shade for the sky-light movable between an open position for uncovering the sky-light and illuminating the light-reflecting material with ambient light to simulate initiation of a heating cycle, and a closed position for covering the sky-light to simulate termination of the heating cycle;

first drive means for moving the shade to its open position; and second drive means coupled to the first drive means for moving the shade to its closed position.

Yet a further object of the invention is to design the shade to provide a light guide for illuminating one or more windows to signal that the oven is turned on and that any food item placed therein is being toasted, baked or the like.

Still another object of the invention is to provide an on-off push button to release the second drive means for returning the shade means to the closed position. Such action simulates turning off the toy toaster oven and rings a bell to indicate that the heating cycle has been terminated.

BRIEF DECRIPTION OF THE DRAWINGS

In the detailed description of the invention presented below, reference is made to the accompanying drawings, in which.

DETAILED DESCRIPTION OF THE INVENTION

Figure 1:
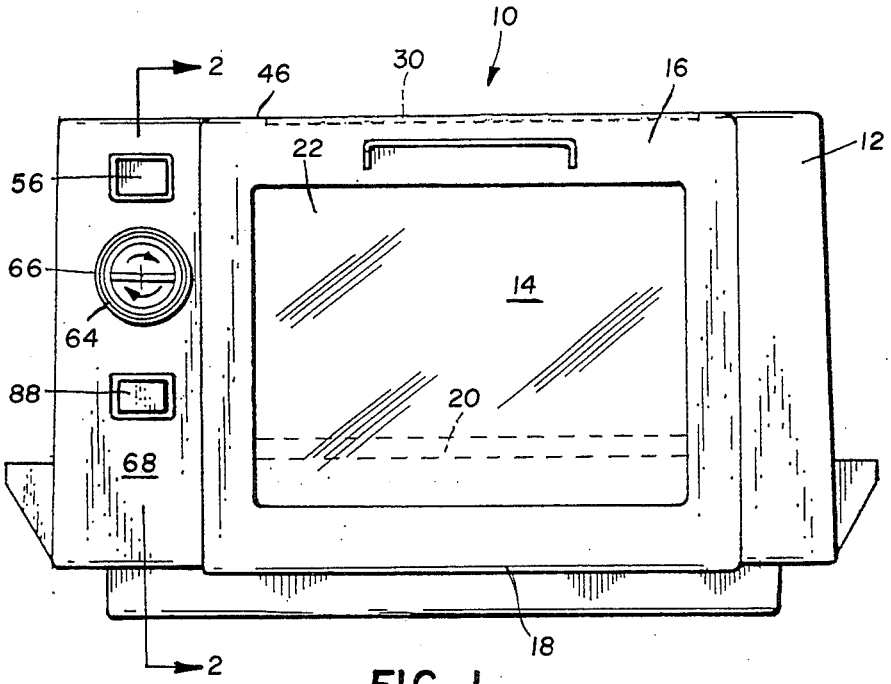
FIG. 1 is a front elevational view of a preferred embodiment of a toy toaster oven in accordance with the present invention.

With reference to FIG. 1, a preferred embodiment of a toy toaster oven 10 of this invention is disclosed comprising a housing 12 defining an oven compartment 14. The toy toaster oven 10 has a front door 16 pivotally mounted along the lower edge 18 therefor for providing access to the oven compartment and further supporting a food rack 20, shown dotted, upon which make-believe food items may be placed for insertion into the oven compartment 14 when the door is closed. The front door 16 further has a clear front window 22 through which the interior of the oven compartment 14 can be viewed.

Figure 3:
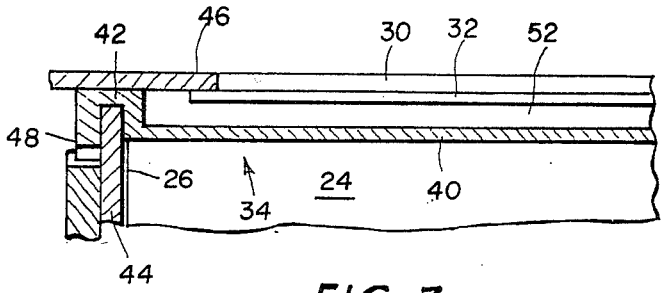
FIG. 3 is a segmental view in section taken substantially along line 3—3 of FIG. 2.
Figure 2:
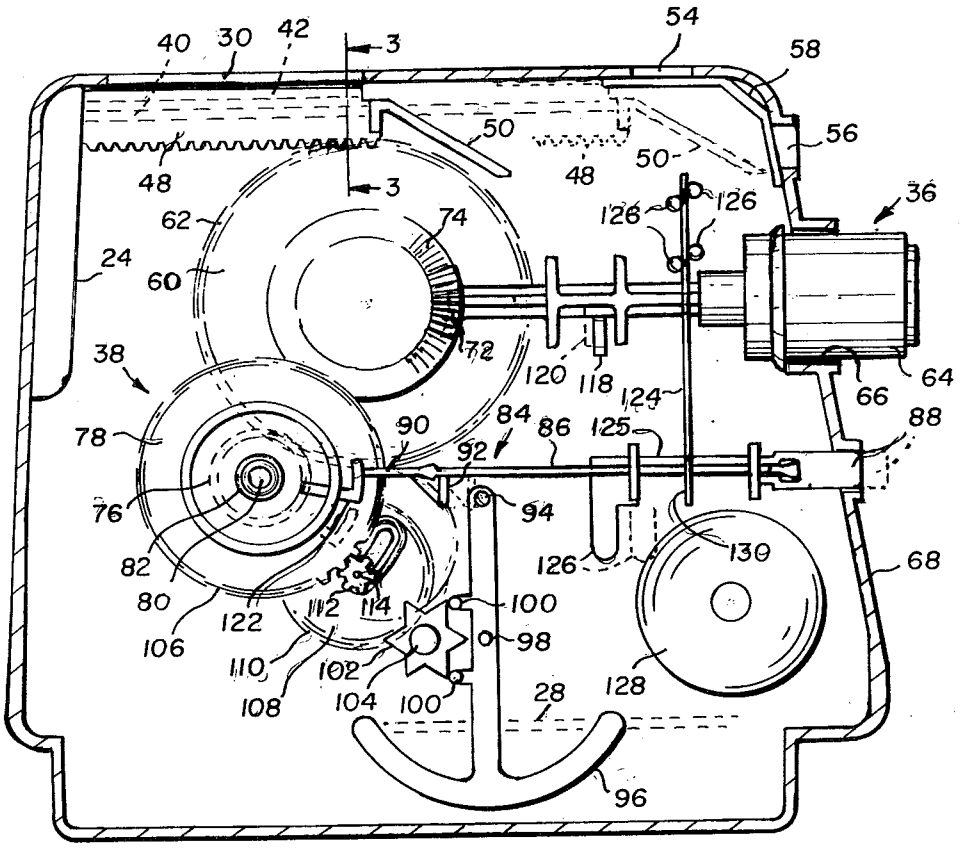
FIG. 2 is an enlarged section view taken substantially along line 2—2 of FIG. 1 showing the shade for the sky-light and the drive means for moving the shade between its open and closed positions.

To simulate a real toaster oven having a red hot glowing electrical heating element, the rear, side and lower surfaces 24, 26, 28 respectively of the oven compartment 14, as best seen in FIGS. 2 and 3, are preferably provided with a light-reflecting material of aluminum sheet material or the like. The top of the housing is provided with a sky-light 30 covered with a translucent material 32 which is tinted a suitable color such as red or orange, as best seen in FIG. 3. Accordingly, when skylight 30 is uncovered, ambient light passes through the orange tinted sky-light and impinges upon the light-reflecting surfaces 24, 26, 28 of oven compartment 14 simulating the appearance of an oven compartment in a real toaster oven in which the heating element is glowing. When sky-light 30 is covered, light cannot pass therethrough, and the only light entering oven compartment 14 passes through the clear front window in the oven door and the toy toaster oven simulates the appearance of an unheated toaster oven.

With reference to FIGS. 2 and 3, shade means 34 are provided for uncovering sky-light 30 to illuminate the light-reflecting material 24, 26, 28 with ambient light to simulate initiation of the heating cycle, and for covering the sky-light to simulate termination of the heating cycle. Also, first drive means 36 are disclosed for moving the shade means to its open position, and second drive means 38 are disclosed for moving the shade means to its closed position.

The shade means 34 comprises an opaque rectangular plate-light shade member 40 slightly larger than sky-light 30. The shade member 40 has a U-shaped end 42, as best seen in FIG. 3, which is slidably mounted for reciprocal movement on the end of a wall member 44 or the like for reciprocal movement along a path that is parallel to the top wall 46 of housing 12 and spaced a short distance therefrom. The U-shaped end 42 of shade member 40 has a gear rack 48 depending therefrom by which the shade member is moved from its normal rest position, shown in full lines in FIG. 2, in which it covers sky-light 30 to prevent ambient light from entering the oven compartment, to its dotted line position shown in FIG. 2, in which skylight 30 is uncovered for illuminating the oven compartment with ambient light. In this latter position, shade member 40 has a front downwardly angled hood 50, (see FIG. 2) which cooperates with the shade member to form a light guide 52 for guiding light from sky-light 30 through the space between shade 40 and top 46 of the housing and through a top window 54 and a front window 56. The top and front windows 54, 56 respectively are preferably covered with a tinted plastic pane 58 which may contain a label and which may indicate to the child by its lighted appearance that the toaster oven 10 is in a simulated heating cycle.

The first drive means 36 for moving shade member 40 from its normal sky-light covered position to a sky-light uncovered position comprises a first gear 60 having outer teeth 62 thereof in meshing engagement with gear rack 48. The first gear 60 is rotatably driven by a winding knob 64 rotatably mounted within an opening 66 in the front wall 68 of housing 12. The winding knob 64 rotates a shaft 70 having a bevel gear 72 mounted thereon which is in meshing engagement with a corresponding bevel gear 74 on first gear 60. Accordingly, rotation of winding knob 64 approximately three quarters of a turn in the clockwise direction rotates first gear 60 for driving gear rack 48 and shade member 40 to its sky-light uncovered position, as seen dotted in FIG. 2.

During the aforementioned rotation of first gear 60, the outer teeth 62 thereof also drive gear teeth 76 of a doublet gear 78 rotatable on a shaft 80. The doublet gear 78 forms part of second drive means 38 which is coupled to a torsion spring 82 for tensioning the spring upon rotation of the gear 60 and doublet gear 78. Accordingly, movement of winding knob 64 through approximately a three-quarter turn not only moves sky-light shade member 40 to the sky-light uncovered position, but also tensions torsion spring 82 of second drive means 38.

The second drive means 38 further has a latch means 84 for latching torsion spring 82 in its tensioned condition, and for unlatching the tensioned torsion spring for driving first gear 60 in a counter-clockwise direction for returning shade member 40 to its normal rest position in which sky-light 30 is covered. The latch means 84 comprises a reciprocally movable arm 86 having a button 88 at one end thereof and a lip 90 at the opposite end thereof engagable with a rib, not shown, on housing 12 for releasably holding arm 86 with the button in its "off" position, as seen in full lines in FIG. 2. In this position, a shoulder 92 on arm 86 is retracted from a laterally extending pin 94 at one end of an anchor-shaped governor 96. The governor is rotatably mounted on a shaft 98 and has a pair of pins 100 on opposite sides thereof for engaging the teeth 102 of a star-shaped member mounted on a star gear 104. The star gear is coupled to gear teeth 106 of doublet gear 78 by an idler doublet gear 108 having teeth 110 in engagement with star-gear 104 and a pinion gear 112 in engagement with teeth 106. The opposite stub shafts 114 of idler gear 108 are mounted in arcuate slots 116 to allow the idler gear to disengage doublet gear 78 when first gear 60 is rotated in a clockwise direction for moving shade member 40 to its sky-light uncovered position. However, when button 88 is pushed into the "off" position as seen in full lines in FIG. 2, the tensioned doublet gear 78 will rotate in a clockwise direction causing idler gear 108 to drive star gear 104 causing teeth 102 thereof to alternately engage pins 100 and drive governor 96 in alternate directions for controlling the speed at which the torsion spring 82 unwinds. Accordingly, the torsion spring unwinds slowly for driving first gear 60 and gear rack 48 in a direction for slowly closing or covering sky-light 30. When shade member 40 fully covers the sky-light, rotation of first gear 60 is stopped by a stop pin 118 on winding knob shaft 70 engaging a flat 120 on the housing 12. As this occurs, a rib 122 on doublet gear 78 strikes lip 90 releasing latch arm 86 which is returned by a flat spring 124 to its "on" position shown in full lines in FIG. 2. The arm 86 further has a striker member 125 having a depending striker finger 126, which strikes a bell 128 mounted on housing 12 for ringing the bell as the arm reaches its "on" position, indicating that the second drive means 38 is latched and the heating cycle has been completed. The flat spring 124 has one end secured to housing 12 between posts 126, and the opposite free and engaging a shoulder 128 on striker member 125 for urging the striker member and arm to its normal "on" position, as seen in FIG. 2.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy toaster oven comprising:

an oven compartment at least partially covered by a light-reflecting material;

a sky-light for the oven compartment, a window through which said oven compartment is visible;

a shade member for the sky-light movable between an open position for uncovering the sky-light and illuminating the light-reflecting material with ambient light to simulate initiation of a heating cycle as viewed through said window, and a closed position for covering the sky-light to simulate termination of the heating cycle; and control means for moving the shade member between open and closed position.

2. A toy toaster oven comprising:

an oven compartment at least partially covered by a light-reflecting material;

a sky-light for the oven compartment;

a shade member for the sky-light movable between an open position for uncovering the sky-light and illuminating the light-reflecting material with ambient light to simulate initiation of a heating cycle, and a closed position for covering the sky-light to simulate termination of the heating cycle; control means comprising first drive means for moving the shade member to its open position; and second drive means coupled to the first drive means for moving the shade member to its closed position.

3. A toy toaster oven comprising:

an oven compartment at least partially covered by a light-reflecting material;

a sky-light for the oven compartment covered with a translucent material; a shade member for the sky-light movable between an open position for uncovering the sky-light and illuminating the light-reflecting material with ambient light to simulate initiation of a heating cycle, and a closed position for covering the sky-light to simulate termination of the heating cycle; and control means for moving the shade member between open and closed position.

4. A toy toaster oven according to claim 3 wherein the translucent material is tinted.

5. A toy toaster oven according to claim 2 wherein the shade comprises a flat opaque plate having a gear rack, and the first drive means comprises a first gear in meshing engagement with the gear rack, and manually operated means for rotating the first gear in one direction for moving the shade to its open position.

6. A toy toaster oven according to claim 5 wherein the manually operated means comprises a manually rotatable knob, and a bevel gear coupling the knob to the first gear.

7. A toy toaster oven according to claim 5 wherein the manually operated means comprises a manually rotatable knob having a shaft, and a bevel gear on the shaft in meshing engagement with the first gear.

8. A toy toaster oven according to claim 5 wherein the second drive means comprises a drive motor coupled with the first gear for rotating the first gear in the opposite direction for moving the shade member to its closed position.

9. A toy toaster oven according to claim 8 wherein the drive motor comprises a torsion spring motor, and rotation of the first gear in the one direction by the manually operated means tensions the torsion spring motor.

10. A toy toaster oven according to claim 9 wherein governor means are provided coupled to the torsion spring motor for controlling the rate at which the first gear is rotated in the opposite direction for moving the shade to its closed position.

11. A toy toaster oven according to claim 10 wherein latch means are provided for latching the torsion spring motor in its tensioned condition.

12. A toy toaster oven according to claim 11 wherein the latch means comprises a manually movable on-off button for latching the torsioned spring motor when the button is in its "on" position and releasing the torsion spring motor when the button is in its "off" position.

13. A toy toaster oven according to claim 12 wherein the second drive means comprises a doublet gear in meshing engagement with the first gear, and the governor means comprises a movable inertia member and gear train means coupling the doublet gear to the inertia member.

14. A toy toaster oven according to claim 13 wherein the inertia member comprises an anchor-shaped member rotatable about an axis and having a pair of spaced pins on opposite sides of the axis, and the gear train means comprises an idler gear in meshing engagement with the doublet gear, a star gear driven by the idler gear, and a star-shaped member on the star gear for intermittently and alternately driving the pins and anchor-shaped member in opposite directions.

15. A toy toaster oven according to claim 14 wherein the latch means comprises a reciprocally movable arm having the on-off button at one end thereof, the arm further having a shoulder movable in the path of the anchor-shaped member for latching the torsioned spring motor when the button is in its "on" position.

16. A toy toaster oven according to claim 15 wherein the arm is flexible and is biased by a spring to its "on" position, the arm further having a lip at the opposite end thereof for engaging a rib on the oven for releasably holding the arm in its "off" position, the doublet gear further having a lug for engaging and releasing the lip for movement of the arm to its "on" position when the torsioned spring motor has moved the shade to its closed position.

17. A toy toaster oven according to claim 16 wherein the oven further has a bell, and wherein the arm has a striker finger for striking the bell when the arm is returned to its "on" position.

18. A toy toaster oven according to claim 5 wherein the plate has an angled hood at the front end thereof for guiding ambient light through the window when the shade is moved to its open position.

19. A toy toaster oven according to claim 18 wherein a tinted translucent pane is mounted in register with the window.

* * * * *